US006341881B1

(12) United States Patent
Huang

(10) Patent No.: US 6,341,881 B1
(45) Date of Patent: Jan. 29, 2002

(54) SINGLE-CONDUCTOR POSITIONING DEVICE ON A BULB HOLDER

(75) Inventor: Peter K. H. Huang, Taipei (TW)

(73) Assignee: Shining Blick Enterprise Co., Ltd. (TW)

( * ) Notice: Subject to any disclaimer, the term of this patent is extended or adjusted under 35 U.S.C. 154(b) by 0 days.

(21) Appl. No.: 09/767,871

(22) Filed: Jan. 24, 2001

(51) Int. Cl.[7] ..... F21V 21/36

(52) U.S. Cl. ..... 362/391; 362/226; 362/396; 362/249; 362/250; 439/456; 439/457; 439/574; 439/449; 439/699.1; 439/699.2; 439/602; 439/611

(58) Field of Search ..... 362/226, 391, 362/249, 250, 396; 439/456, 457, 574, 449, 699.1, 699.2, 602, 611

(56) References Cited

U.S. PATENT DOCUMENTS 5,632,552 A * 5/1997 Wang et al. ..... 362/396
5,915,827 A * 6/1999 Wang ..... 362/396
5,941,628 A * 8/1999 Chang ..... 362/391
6,082,874 A * 7/2000 Huang ..... 362/226
6,116,951 A * 9/2000 Shu ..... 439/574

* cited by examiner

*Primary Examiner*—Sandra O'Shea
*Assistant Examiner*—Guiyoung Lee
(74) *Attorney, Agent, or Firm*—Troxell Law Office PLLC

(57) ABSTRACT

A single-conductor positioning device on each or either lateral side of a bulb holder, wherein, a receiving seat is integrally formed on the side of the bulb holder and is comprised of two hook-like sidewalls opposite to each other and forming an inner slot and a central slit. The wall portions of the sidewalls on both sides of the central slit are further folded to form respectively hooks. A recessed surface is formed centrally on an inner wall of the inner slot. A plug with a base can be fitted in the receiving seat, and has vertical grooves for connecting with the hooks on the receiving seat. The plug has a clamping recess provided in opposition to the recessed surface to form together with the latter a conductor clamping-slot. Inserting of the plug into the receiving seat can firmly position the conductor at a central position on the lateral side of the bulb holder; engagement of the plug with the vertical grooves can prevent the central slit from pulling outwardly.

7 Claims, 5 Drawing Sheets

FIG. 3
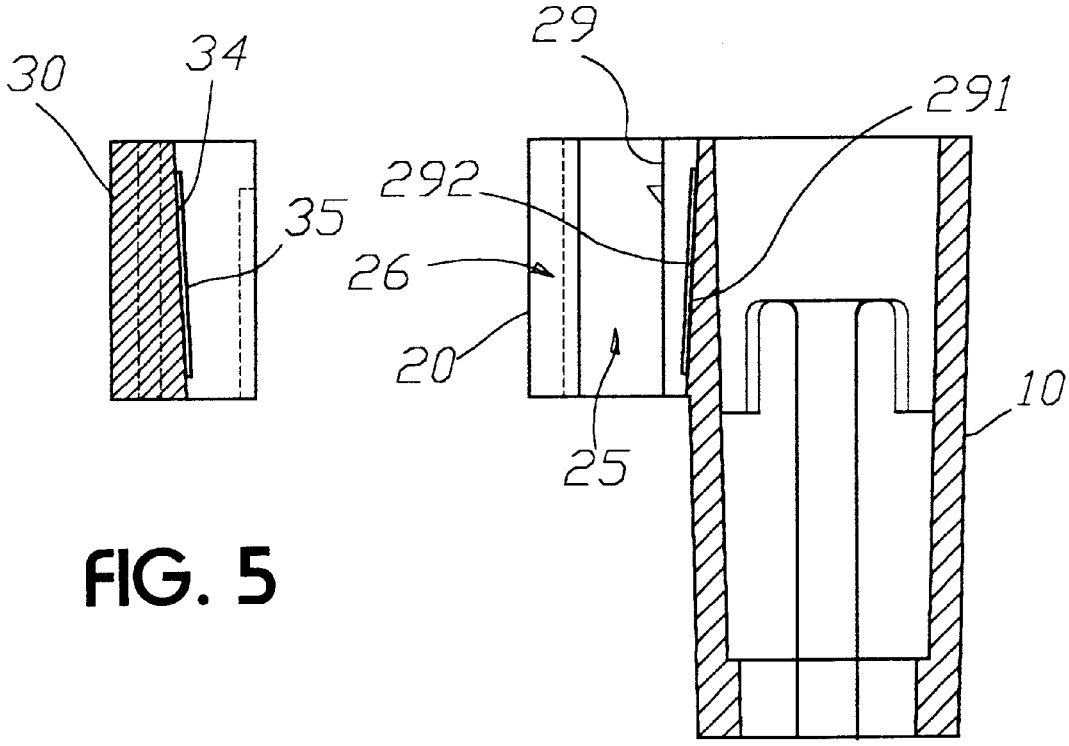
FIG. 5
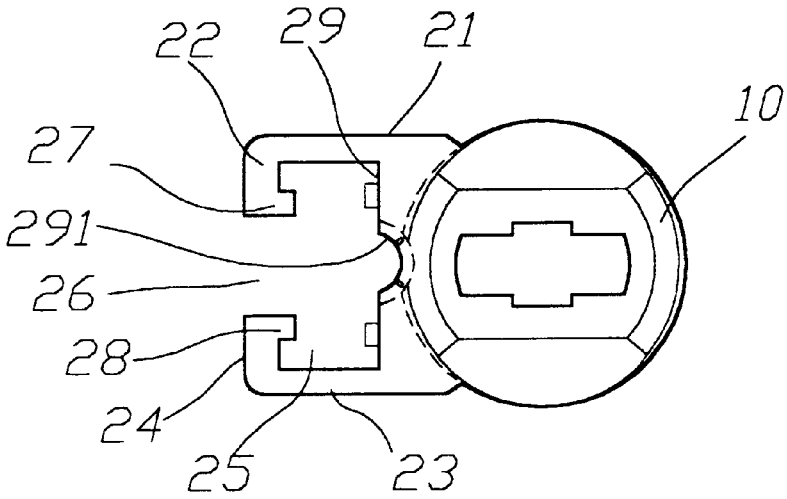
FIG. 4

SINGLE-CONDUCTOR POSITIONING DEVICE ON A BULB HOLDER

BACKGROUND OF THE INVENTION

1. Field of the Invention

The present invention is related to a single-conductor positioning device on each or either lateral side of a bulb holder, and especially to such a device capable of firmly positioning a single conductor at a central position on each or either lateral side of the bulb holder.

2. Description of the Prior Art

Conventional decorative lamps are mostly in the form of strings each having multiple lamp bulbs connected to a conductor; modern decorative lamps of such kind are arranged in a plane in the form of a net, thereby conventional lamp strings were developed to have the plane decorative function.

Early decorative lamps in the form of nets, such as that in the U.S. Pat. No. 5,662,409 owned by the applicant of the present application, must have multiple lamp bulbs positioned at different locations on the entire network, hence locking members are required to secure every lamp bulb on the net formed by conductor for the lamp bulbs.

Using the locking members on decorative lamps in the form of nets to position multiple lamp bulbs not only is inconvenient in construction, but also is uneconomic. In view of this, modern decorative lamps in the form of nets have for each bulb holder a conductor-positioning device integrally formed therewith to save the abovementioned locking members additionally provided. Such an integrally formed conductor-positioning device was disclosed in U.S. Pat. Nos. 5,839,819, 5,908,238 and 6,116,951.

In the U.S. Pat. No. 5,839,819 as an example, a connecting base is integrally formed on a lateral side of the bulb holder; the connecting base has an outward groove, thereby, the conductor for the lamp bulbs can be placed in the connecting base through the groove. Although the patent has the advantage of omitting a locking member additionally provided and fast positioning on the conductor, the front face of the outward groove faces to the lateral side of the bulb holder, thereby, when the decorative lamps in the form of a net is pulled sideways, the outwardly facing direction of the groove for clamping therein the conductor is coincident with the direction of stretching of the net light. In this mode, the bulb holder and its lamp bulb are much subjected to getting off their positions when the conductors are exerted with pulling force. Thereby, the whole net light looses its static or dynamic flashing or illuminating patterns previously set. Such a connecting base with the outward groove on the lateral side totally opened is subjected to pulling sideways and thus lack of the ability of sure positioning the conductor.

The U.S. Pat. No. 6,116,951 also provided a conductor clamping device for such a net light; wherein, the bulb holders each is also integrally formed with a connecting base merely the same as that of the aforesaid connecting base. The connecting base is provided on a lateral side thereof with a protruding rib which is connected to the connecting base by means of an engagement block; the engagement block is provided with a concave groove matching with the protruding rib. Thereby, the engagement block can synchronically position two conductors passing through the corresponding lamp bulbs and its bulb holders when it is connected to the connecting base.

However, such a net light generally has singular conductors passed through lamp bulbs and their corresponding bulb holders in the process of manufacturing. Positioning of a singular conductor must be very firm to prevent getting off during pulling sideways, and must be accurately positioned at the centers of the lateral sides of the bulb holders. In this mode, fixed assembling of the entire net light can only be assured, and the lamp bulbs can surely be located at the intercrossing points of net lines, such locating can influence the pattern of flashing of the lamp bulbs. The above stated U.S. Pat. No. 5,839,819 is unable to get firm positioning of the conductor; while the U.S. Pat. No. 6,116,951 is evidently hard to suit accurate positioning of the conductor.

SUMMARY OF THE INVENTION

The object of the present invention is to provide a single-conductor positioning device on each or either lateral side of a bulb holder; the device is capable of firmly positioning a single conductor at a central position on each or either lateral side of the bulb holder.

To obtain the above stated object, the present invention is provided with a receiving seat integrally formed on each or either lateral side of the bulb holder and comprised of two hook-like sidewalls opposite to each other. A plug can be fitted in an inner slot and a central slit both formed in the receiving seat. In this preferred embodiment, the plug can form together with the inner slot of the receiving seat a conductor clamping-slot; and can further be provided with vertical grooves for connecting with the hooks of the sidewalls of the receiving seat. Thus the phenomenon that the outward groove of a connecting base is subjected to pulling sideways to make a conductor get off its position by a pulling force can be effectively prevented.

In this preferred embodiment, the plug has a base slightly enlarged and used as a limit portion against pushing.

And in another preferred embodiment, the conductor clamping-slot formed by a recess of the plug and the receiving seat is formed to be a conical hole, and has a raised strip.

In another preferred embodiment, the plug can be formed independently a conductor sleeve on the external surface of the receiving seat.

The present invention will be apparent in its novelty and features after reading the detailed description of the preferred embodiment thereof in reference to the accompanying drawings.

BRIEF DESCRIPTION OF THE DRAWINGS

FIG. 3 is a sectional view of the bulb holder shown in FIG. 1;

FIG. 4 is a bottom view of the bulb holder shown in FIG. 1;

FIG. 5 is a sectional view of the plug shown in FIG. 1;

DETAILED DESCRIPTION OF THE PREFERRED EMBODIMENT

Figure 1:
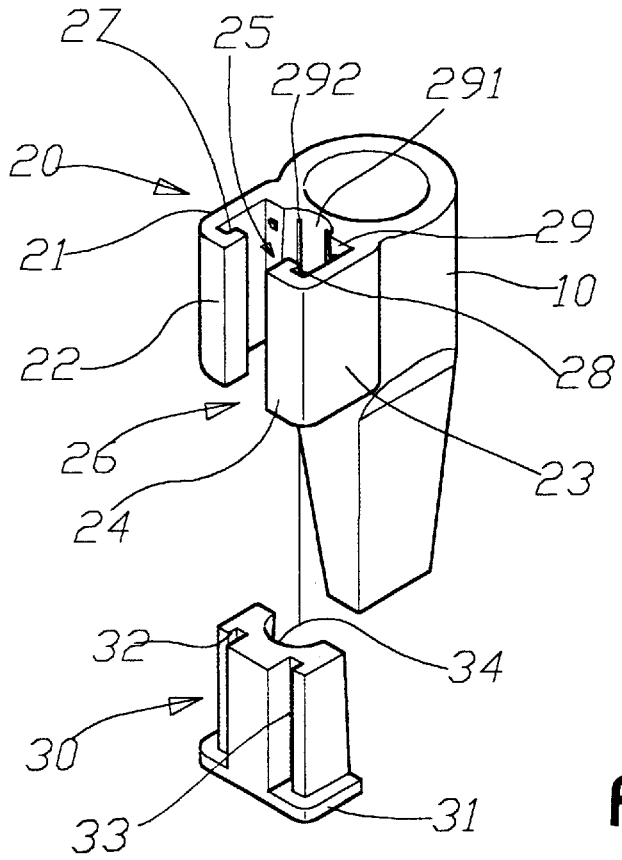
FIG. 1 is an analytic perspective view showing elements of the present invention, wherein, the receiving seat and the plug are provided on only one lateral side of the bulb holder.

Referring to FIG. 1, the present invention is provided with a receiving seat 20 integrally formed on one lateral side of a bulb holder 10. In a preferred embodiment, the receiving seat 20 is comprised of two hook-like sidewalls opposite to each other and each including a pair of integral but mutually perpendicular wall portions 21, 22 and 23, 24. An inner slot 25 is formed within the wall portions 21, 22 and 23, 24; and a central slit 26 with a width slightly smaller than the diameter of a conductor is formed in the receiving seat 20. The wall portions 22, 24 on both sides of the central slit 26 are further folded to form respectively hooks 27, 28. A recessed surface 291 is formed centrally on an inner wall 29 of the inner slot 25, in this preferred embodiment, the recessed surface 291 is a conical surface which is smaller at the upper portion than the lower portion thereof (referring to FIGS. 3, 4), and has a raised strip 292 on the surface thereof.

A plug 30 has a section in the shape matching with the shapes of the inner slot 25 and the central slit 26 of the bulb holder 10. In this preferred embodiment, the plug 30 has a base 31, and has two vertical grooves 32, 33 respectively in opposition to the aforementioned hooks 27, 28, and a clamping recess 34 is provided in opposition to the aforementioned recessed surface 291. The clamping recess 34 is preferably a part of a conical surface which is larger at the upper portion than the lower portion thereof, and has a raised strip 35 on the surface thereof (referring to FIG. 5).

Figure 2:
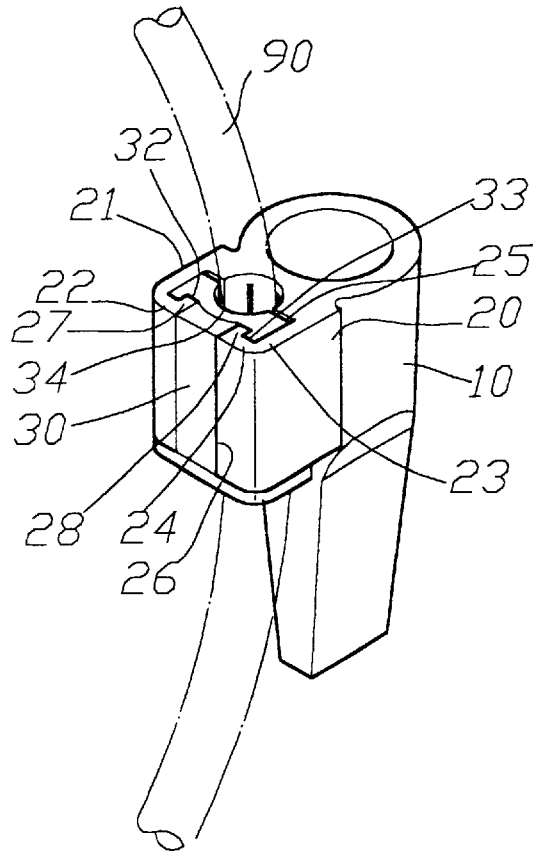
FIG. 2 is a perspective view showing assembling and positioning of a single conductor of FIG. 1.

And as shown in FIGS. 1 and 2, according to the above stated embodiment, a conductor 90 can be pressed into the inner slot 25 through the central slit 26 of the bulb holder 10, then the plug 30 is inserted in from the bottom of the receiving seat 20. During the process of assembling, the recessed surface 291 and the clamping recess 34 of the plug 30 together form a clamping hole for the conductor 90. By cooperation of tight pressing of the plug 30 and the raised strips 292, 35 respectively on the recessed surface 291 and the clamping recess 34, it is assured that the conductor 90 can be tightly positioned. At the same time, when the plug 30 is pressed for assembling, the clamping recess 34 is slipped over the aforementioned hooks 27, 28 of the receiving seat 20. Such an assembly can render the wall portions 21, 22 and 23, 24 of the receiving seat 20 to be clamped and restrained; the central slit 26 will not be pulled to stretch to make dropping of the conductor 90 therein no matter it is pulled in any direction. The base 31 of the plug 30 will be used as a positioning member during press insertion; when the plug 30 is completely inserted, the base 31 will abut against the bottom face of the receiving seat 20 to stop further pushing of the plug 30.

Figure 6:
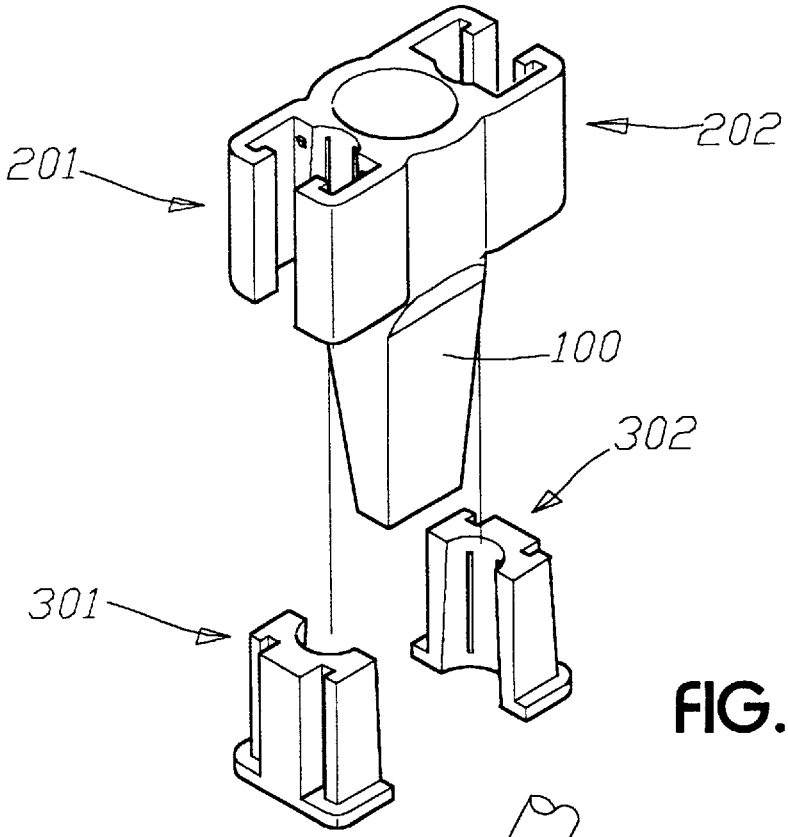
FIG. 6 is an analytic perspective view showing elements of the present invention similar to FIG. 1, wherein, receiving seats and plugs are provided on both lateral sides of the bulb holder.
Figure 7:
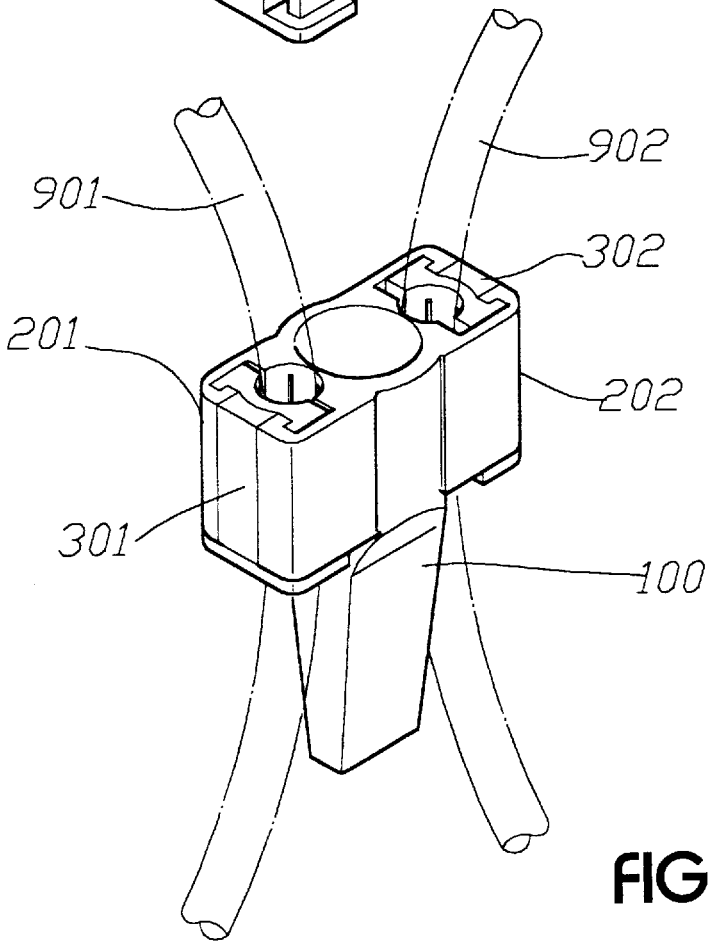
FIG. 7 is a perspective view showing assembling and positioning of the elements of FIG. 6.

In the embodiment shown in FIG. 6, two receiving seats 201, 202 are simultaneously provided on two opposite lateral sides of a bulb holder 100, and two plugs 301, 302 are used, such that the bulb holder 100 can have two singular conductors 901, 902.

Figure 8:
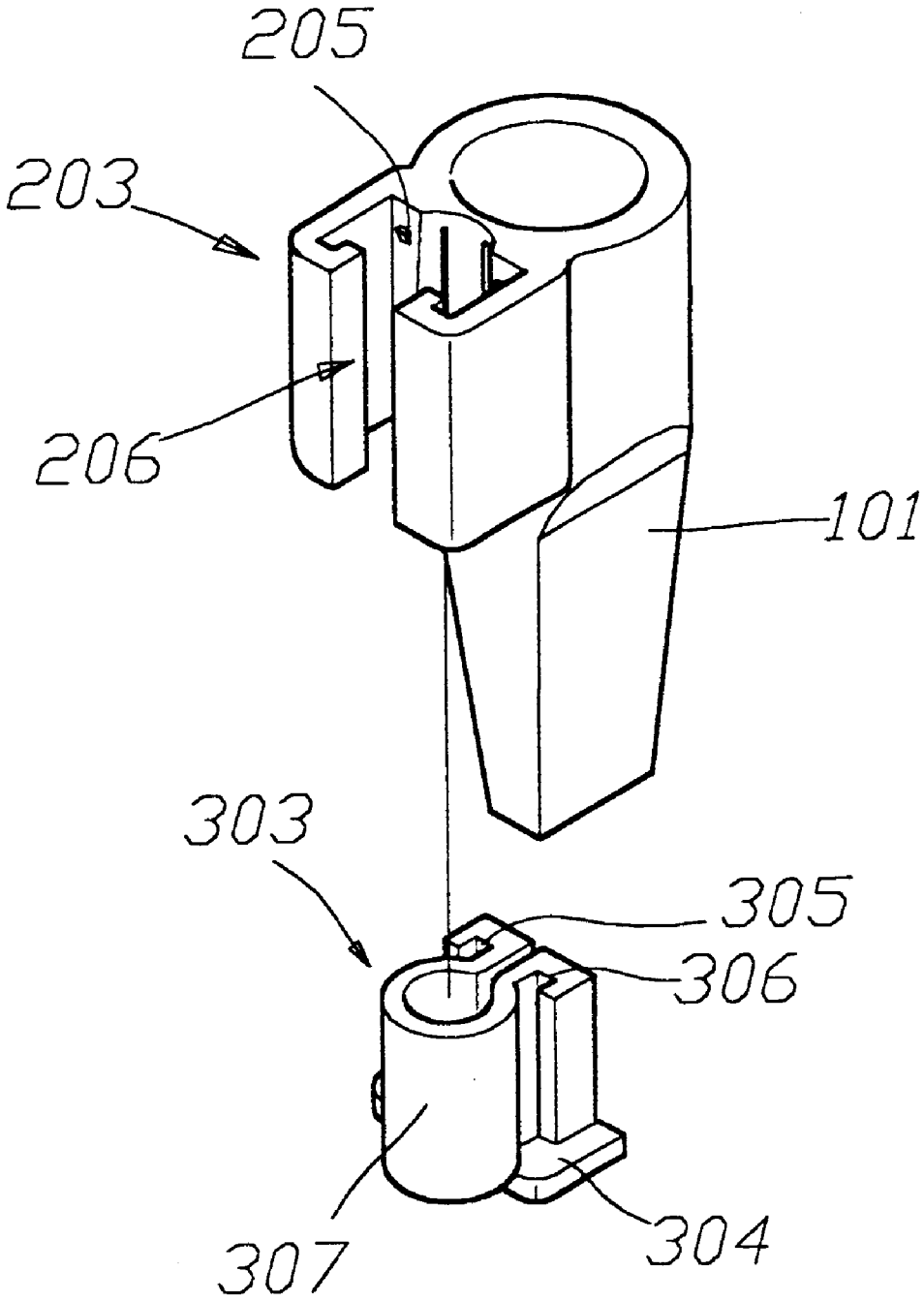
FIG. 8 is a perspective view showing another embodiment of the present invention.

FIG. 8 shows another embodiment of the present invention, wherein, a bulb holder 101 is provided with a receiving seat 203 on one side thereof. However, the inner slot 205 thereof can have a slightly reduced width. With the inner slot 205 and a central slit 26 of the receiving seat 203, a plug 303 in this embodiment can similarly be provided with a base 304 having in the receiving seat 203 vertical grooves 305, 306, but a sleeve 307 is formed extending outwardly for clamping a conductor. When the plug 303 is combined with the receiving seat 203, the conductor can be positioned at a central position on the external surface of the receiving seat 203.

Figure 9:
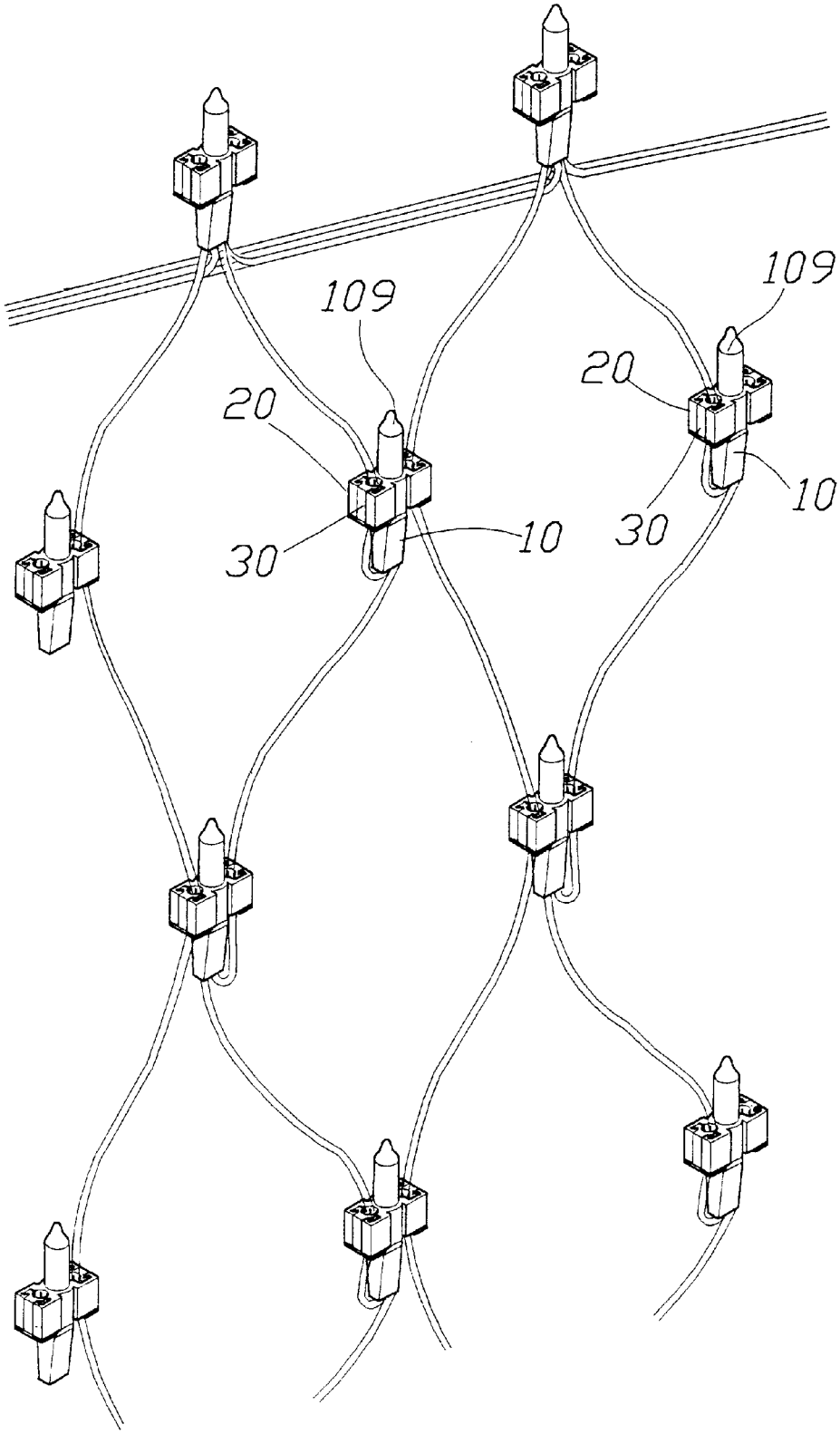
FIG. 9 is a schematic perspective view showing using of the present invention in a net light.

FIG. 9 shows that the embodiment of FIG. 6 of the present invention is applied in a net light. It can be seen, singular conductors 90 of every bulb holder 10 is firmly positioned at a central line on both sides of the bulb holder 10. In this way, not only that the conductors 90 are not easy to drop in pulling, the lamp bulb 109 on each bulb holder 10 is also accurately positioned at an intercrossing point of net lines, thereby, the entire net light can have more tidy and reliable pattern expressing and flashing under the control of an electric circuit (not shown).

The embodiment cited above is only for illustrating a preferred embodiment of the present invention. It will be apparent to those skilled in this art that various modifications or changes can be made to the elements of the present invention without departing from the spirit and scope of this invention. Accordingly, all such modifications and changes also fall within the scope of the appended claims and are intended to form part of this invention.

What is claimed is:

1. A bulb holder having a single-conductor positioning device extending from at least one lateral side thereof including a receiving seat comprising two spaced apart hook-like sidewalls bounding therebetween an inner slot and a central slit, said two hook-like sidewalls having end portions forming hooks; a first recessed conical surface formed on a wall of the bulb holder and located in said inner slot; a plug having a cross-sectional shape matching with cross-sectional shapes of said inner slot and said central slit, the plug having a base fitting in said receiving seat, the plug having grooves engaged with said hooks on said wall portions of said receiving seat, said plug has a second conical recessed surface facing said first recessed conical surface thereby forming a conductor clamping-slot for clamping a conductor wire therebetween.

2. The bulb holder as claimed in claim 1, wherein said first and second conical surfaces each have at least one raised strip thereon.

3. The bulb holder as claimed in claim 1, wherein said receiving seat and said plug corresponding thereto are provided on a single lateral side of said bulb holder.

4. The bulb holder as claimed in claim 1, wherein said receiving seat and plug are provided on opposite lateral sides of said bulb holder.

5. A bulb holder having a single-conductor positioning device extending from a lateral side thereof, including a receiving seat comprising two spaced apart, hook-like sidewalls bounding therebetween an inner slot and a central slit, said two hook-like sidewalls having end portions forming hooks; a recessed conical surface formed on a wall of the bulb holder and located in said inner slot; a plug having a base fitting in said receiving seat, the plug having walls with vertical grooves engaged with said hooks on said wall portions of said receiving seat, said plug having a clamping recess opposite from said recessed surface to thereby form together a conductor clamping-slot, the plug having a sleeve formed by extensions of the walls for clamping a conductor.

6. The bulb holder as claimed in claim 5, wherein said receiving seat and plug are provided on a single lateral side of said bulb holder.

7. The bulb holder as claimed in claim 5, wherein said receiving seat and plug are provided on opposite lateral sides of said bulb holder.

* * * * *